US005547097A

United States Patent [19]

Lyon

[11] Patent Number: 5,547,097

[45] Date of Patent: Aug. 20, 1996

[54] CONTAINER ASSEMBLY FOR WASTE

[75] Inventor: John C. Lyon, Spalding, Great Britain

[73] Assignees: David J. Dawe; Philip A. Munnelly, both of Great Britain; a part interest

[21] Appl. No.: 146,042

[22] PCT Filed: Apr. 28, 1992

[86] PCT No.: PCT/GB92/00781

§ 371 Date: Dec. 9, 1993

§ 102(e) Date: Dec. 9, 1993

[87] PCT Pub. No.: WO92/19516

PCT Pub. Date: Dec. 11, 1992

[30] Foreign Application Priority Data

May 1, 1991 [GB] United Kingdom ..... 9109453

[51] Int. Cl.[6] ..... B65D 90/00

[52] U.S. Cl. ..... 220/23.83; 220/909; 414/406

[58] Field of Search ..... 220/23.83, 909, 220/527, 528; 414/406, 407

[56] References Cited

U.S. PATENT DOCUMENTS

| | | | |
|---|---|---|---|
| 3,211,312 | 10/1965 | Miller | 414/406 |
| 3,823,972 | 7/1974 | Ramer | 414/406 X |
| 4,834,253 | 5/1989 | Crine | 220/23.83 X |
| 4,960,220 | 10/1990 | Foa | 220/23.83 |
| 4,975,019 | 12/1990 | Cate et al. | 220/23.83 X |
| 5,098,250 | 3/1992 | Carson | 220/909 X |
| 5,111,958 | 5/1992 | Witthoeft | 220/23.83 X |
| 5,119,958 | 6/1992 | Gabert et al. | 220/909 X |
| 5,205,698 | 4/1993 | Mezey | 414/406 |

*Primary Examiner*—Steven M. Pollard
*Attorney, Agent, or Firm*—Bachman & LaPointe, P.C.

[57] ABSTRACT

A waste container assembly (10) comprising a housing (11) adapted for engagement with a tipping apparatus capable of raising the housing to an elevated tipped position, and one or more mobile containers (12) located within the housing, the housing and mobile container(s) co-operating to hold the mobile container(s) captive within the housing, the mobile containers are emptied into a refine collecting vehicle.

9 Claims, 5 Drawing Sheets

CONTAINER ASSEMBLY FOR WASTE

BACKGROUND OF THE INVENTION

The present invention relates to a container assembly.

Disposal of waste, such as domestic or industrial waste, is commonly achieved by means of a waste container located on site which is periodically emptied by a vehicle. Usually the vehicle arrives on site, engages the waste container, lifts and tips the container to empty the contents of the container into a larger container provided on the vehicle. The vehicle then deposits the emptied container and travels to another site taking away the waste contents for disposal. Two types of vehicle are commonly used, viz a front end loading vehicle and a rear end loading vehicle.

For each type of vehicle the lifting equipment for engaging the waste container is usually of a specific size for engaging a specific size of waste container. Thus a waste disposal company may have a fleet of differently sized vehicles for servicing differently sized containers.

Large waste containers are favoured for the waste disposal company since it means that a vehicle need only be on site for a relatively short time in order to empty a relatively large amount of waste. However, large waste containers are restrictive on site since they tend to be static due to their size. This means that a central waste disposal point is created which is not necessarily convenient to the entire site.

Accordingly, for site use, smaller mobile containers can be preferable since this enables leach container to be located at a convenient position on site. This is particularly so for example in a multi-storey building complex where small mobile containers can be sited throughout the complex for filling and then wheeled to a central site for emptying.

It is a general aim of the present invention to provide a container assembly which provides the advantages of large containers for emptying and which also provides the advantages of small mobile containers for filling.

SUMMARY OF THE INVENTION

According to one aspect of the present invention there is provided a waste container assembly comprising a housing adapted for engagement with a tipping apparatus capable of raising the housing to an elevated tipped position, and one or more mobile containers located within the housing, the housing and mobile container(s) co-operating to hold the mobile container(s) captive within the housing when at said elevated tipped position. In accordance with one embodiment the housing is open topped and is provided with tipping support means located adjacent said open top which are engageable with an upper edge of said mobile container(s) when in said tipped position to retain the container(s) within the housing.

In accordance with another embodiment of the invention the housing is open topped and is provided with tipping support means located below said open top which are engageable with co-operating tipping support means formed on said mobile container(s).

Various aspects of the present invention are hereinafter described with reference to the accompanying drawings, in which:

DETAILED DESCRIPTION OF THE PREFERRED EMBODIMENT

Figure 1:
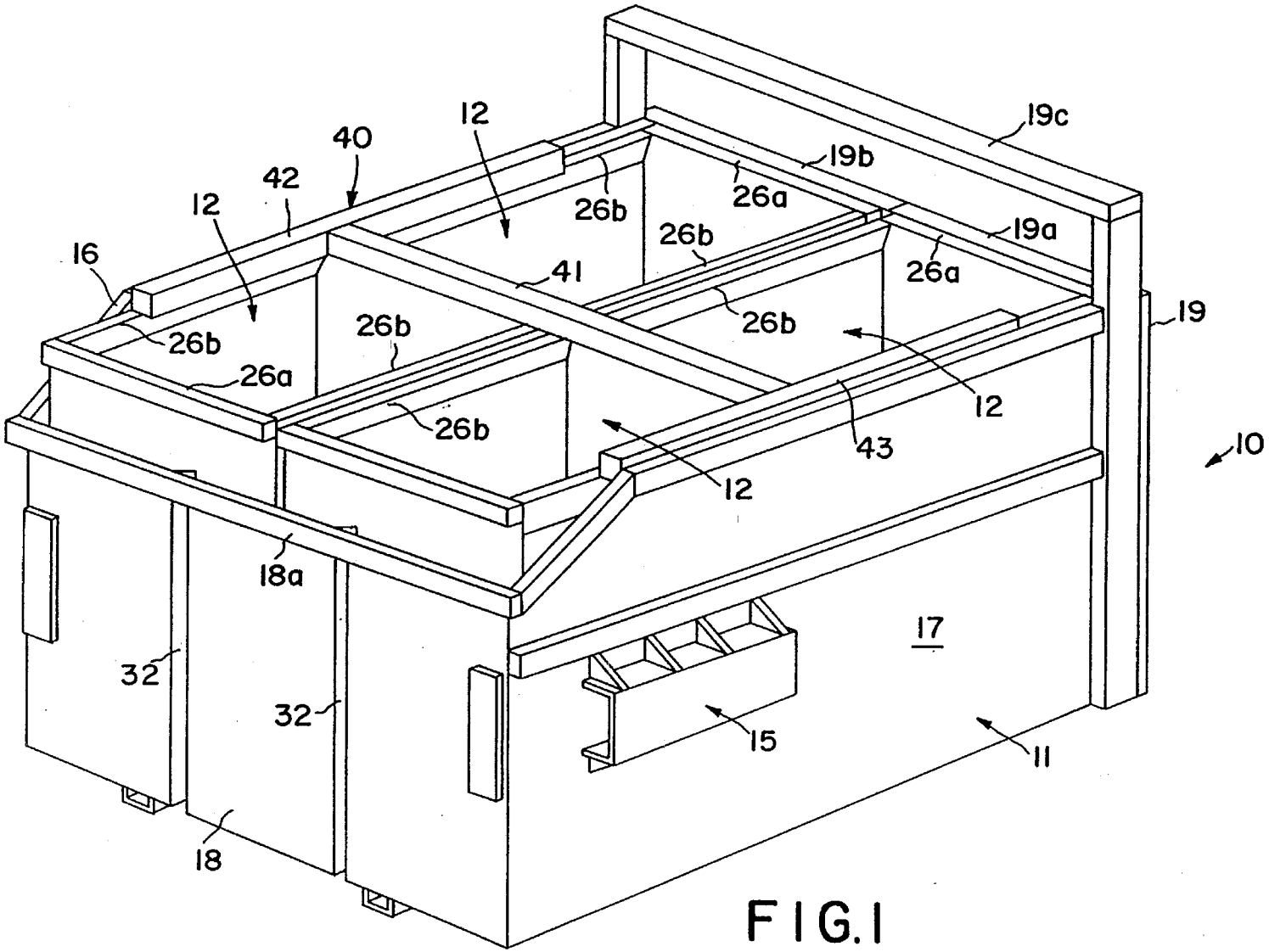
FIG. 1 is a perspective view of a container assembly according to a first embodiment of the present invention.
Figure 2:
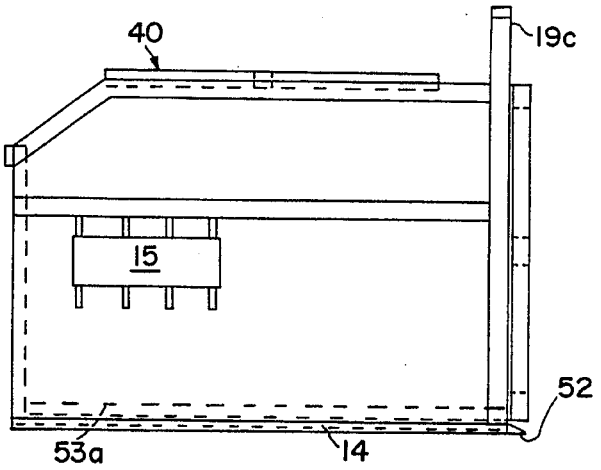
FIG. 2 is a side view of a container housing shown in FIG. 1.
Figure 3:
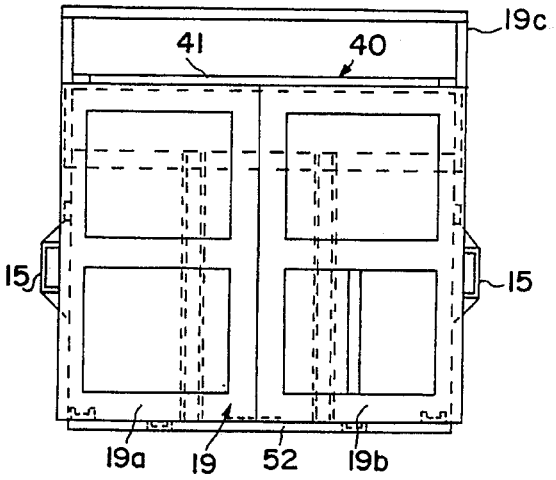
FIG. 3 is an end view of the container housing shown in FIG. 2.
Figure 4:
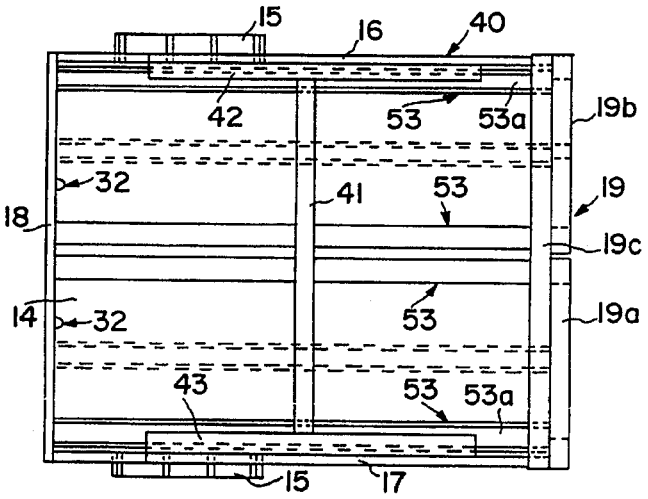
FIG. 4 is a plan view of the container housing shown in FIG. 2.

The container assembly 10 according to the present invention includes a housing 11 and a plurality of mobile containers 12 located within the housing 11.

The housing 11 has a floor 14, a pair of opposed side walls 16,17 and opposed end walls 18,19. Each side wall 16,17 is provided with a channel member 15 which are located in a suitable position to receive a lifting fork (not shown) of a front end loading vehicle in a known manner.

In the illustrated embodiment, four mobile containers 12 are provided, each of which is generally rectangular or square in cross-section and are so sized as to nest together to fill the internal space of the housing 11 defined between the opposed side walls 16,17 and opposed end walls 18,19.

Preferably when received in the housing 11 in the nested condition, the containers 12 are restrained against relative lateral movement by mutual abutment of the containers 12 with one another and the walls 16,17.

Figure 5:
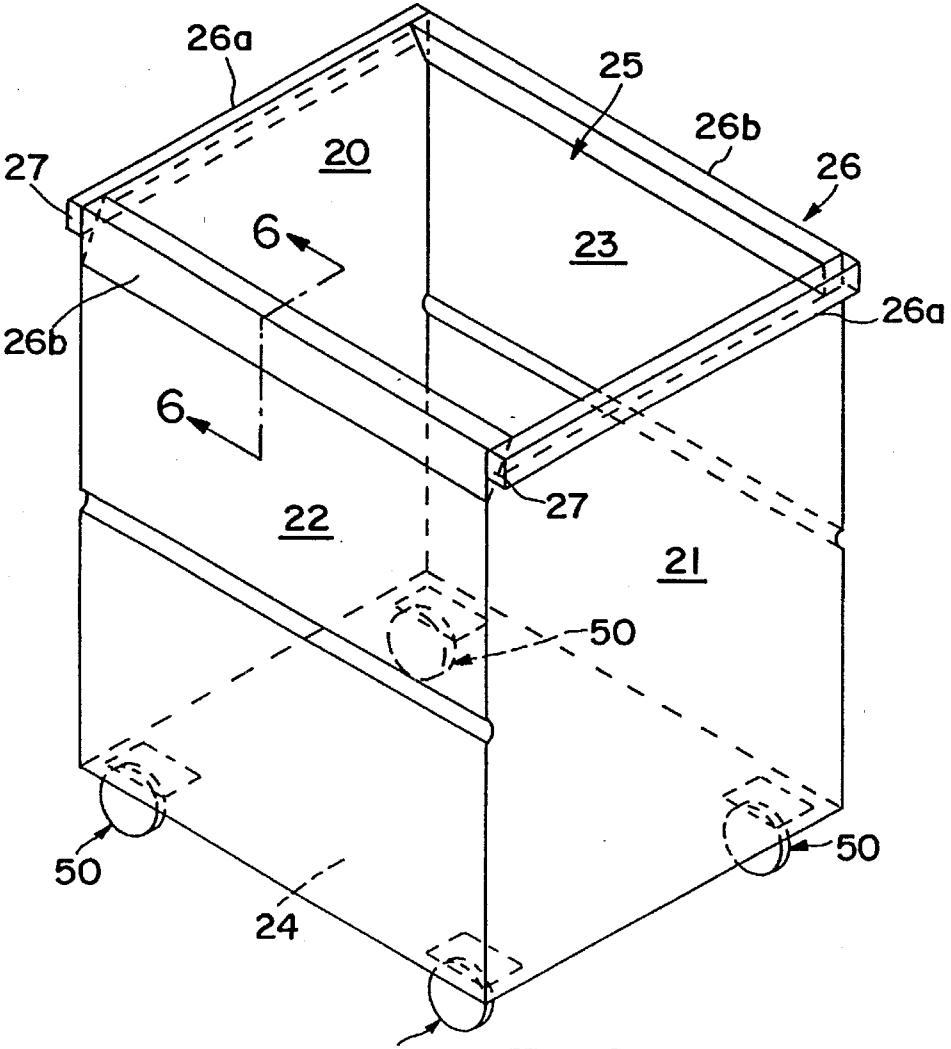
FIG. 5 is a perspective view of one of the mobile containers shown in FIG. 1.

Each container 12 includes opposed end walls 20,21, opposed side walls 22,23, a closed bottom 24 and an open top 25. As seen in FIG. 5 the Open top 25 is preferably defined by a rim 26 which extends around the periphery defined by the upper edges of walls 20,21,22 and 23.

Figure 6:
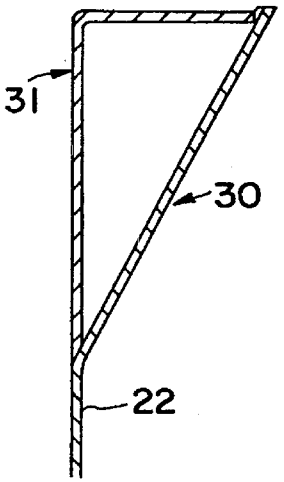
FIG. 6 is a part sectional view taken along line 6—6 in FIG. 5.

The portion **26*a* of a rim 26 extending along the upper edges of walls 20,21 protrude outwardly of walls 20,21 and the portion 26*b* of rim 26 extending along the upper edges of walls 22,23 protrude inwardly of walls 22,23. As seen in FIG. 5, rim portions 26*a* are preferably formed from a box-sectioned elongate member 27 which is secured to the upper marginal edges of walls 20,21 whereas rim portions 26*b* are formed by folding the upper marginal portion 30 of walls 22,23 inwardly (see FIG. 6) and securing an angled elongate member 31 to the folded marginal portion 30. In this way the upper edges of walls 20,21,22 and 23 are reinforced and for walls 22,23 the marginal portion 30 acts as a deflection guide for material contained in the container 12** during emptying.

When the containers 12 are located within the housing 11 the rims 26 of adjacent containers are located in close proximity to one another and also to side walls 16,17 and end wall 19 of the housing 11. This provides minimum gaps between the containers 12 and container 11 so as to discourage waste material falling therebetween.

The front end wall 18 of the housing 11 preferably has an upper edge **18*a* which is lower in height than the rims 26 of adjacent containers 12**. This is desirable for use with conventional front end loading vehicles.

In order to prevent rim portions 26*a* of the containers 12 adjacent wall 18 from projecting beyond the external face of wall 18, stop formations 32 are preferably provided which engage end walls 20(or 21). The stop formations 32 are preferably elongate so as to provide an abutment support along substantially the entire height of an adjacent container 12 during tipping.

The housing 11 is generally open topped and is provided with a container tipping support 40 which co-operates with the rims 26 of the containers in order to prevent the containers 12 from falling out of the housing 11 during tipping for emptying of containers 12.

Preferably the tipping support 40 comprises an elongate cross-member 41 which extends between side walls 16,17 and is located so as to be positioned above and span across rim portions 26*a* of adjacent containers 12. In addition the support 40 preferably includes a pair of elongate members 42,43 which are respectively secured to side walls 16,17 to define inwardly directed lips positioned above rim portions 26*b* of containers 12 located adjacent to walls 16,17.

Preferably the support members 41,42,43 are secured together to form a H shaped frame which is secured to the walls 16,17.

Each container 12 is provided with bogey wheels 50 to thereby render each container 12 mobile and enable them to be wheeled to a desired site.

The rear end wall 19 is adapted to be opened, preferably by the provision of two hinged doors 19*a*,19*b*, to thereby enable the containers 12 to be wheeled out of and into the housing 11. In order to provide support for the hinged doors 19*a*,19*b*, the housing 11 is provided with a reinforcement frame 19*c* for rigidly connecting sides 16,17 to one another. To facilitate entry and removal, the floor 14 is preferably provided with a ramp 52.

Preferably the floor 14 is provided with tracks 53 along which the wheels of the containers are intended to run; a pair of tracks being provided for each longitudinal row of containers 12. Preferably at least one track 53*a* of each pair of tracks is defined by a U-shaped channel which co-operates with the wheels of the container 12 to guide its movement during loading and unloading of the housing 11. The tracks 53 also serve to reinforce the floor 14 in the areas where the containers are supported.

It will be appreciated that the floor 14 may be open and defined by tracks 53 only.

Alternatively the tracks 53 may be omitted.

In use, empty containers 12 are unloaded from the housing 11 by removing wall 19 (ie opening doors 19*a*,19*b*) and are wheeled to a desired site for filling. Since the containers 12 may be relatively small, compared to the size of housing 11, they can be wheeled into lifts of multi-storey buildings and left on appropriate floors for filling.

Once filled, the containers 12 are wheeled into the housing 11 to form a nested arrangement as shown in FIG. 1. The end wall 19 is then closed, and possibly locked, to await a front end loading vehicle for emptying. Emptying is achieved in a conventional manner by virtue of the front end loading vehicle engaging the housing 11, and then raising the housing 11 to an elevated tipped position such that its open top is tipped to an upside down position to permit the contents of all the containers 12 to fall into the container of the vehicle. Accordingly all containers 12 are emptied at the same time by one tipping operation of the vehicle which is significantly faster than if each container 12 were emptied individually.

In the illustrated embodiment, four mobile containers 12 are provided. It will be appreciated however that a different number of containers 12 may be provided. For example, three containers arranged in a single row may be provided, the containers having a width extending across substantially the entire width between side walls 16,17. In such an arrangement the tipping support may comprise members 42,43 only.

In the illustrated embodiment two longitudinal rows of containers are provided extending between end walls 18,19 and two transverse rows of containers are provided extending between side walls 16,17. The support member 41 extends between the adjacent transverse rows of containers. If more than two transverse rows of containers are provided, then a support member 41 is preferably provided extending between each adjacent row ie if there are three transverse rows then two support members 41 would be provided.

Preferably the housing 11 and each of the containers 12 is fabricated from steel sheet material.

Figure 7:
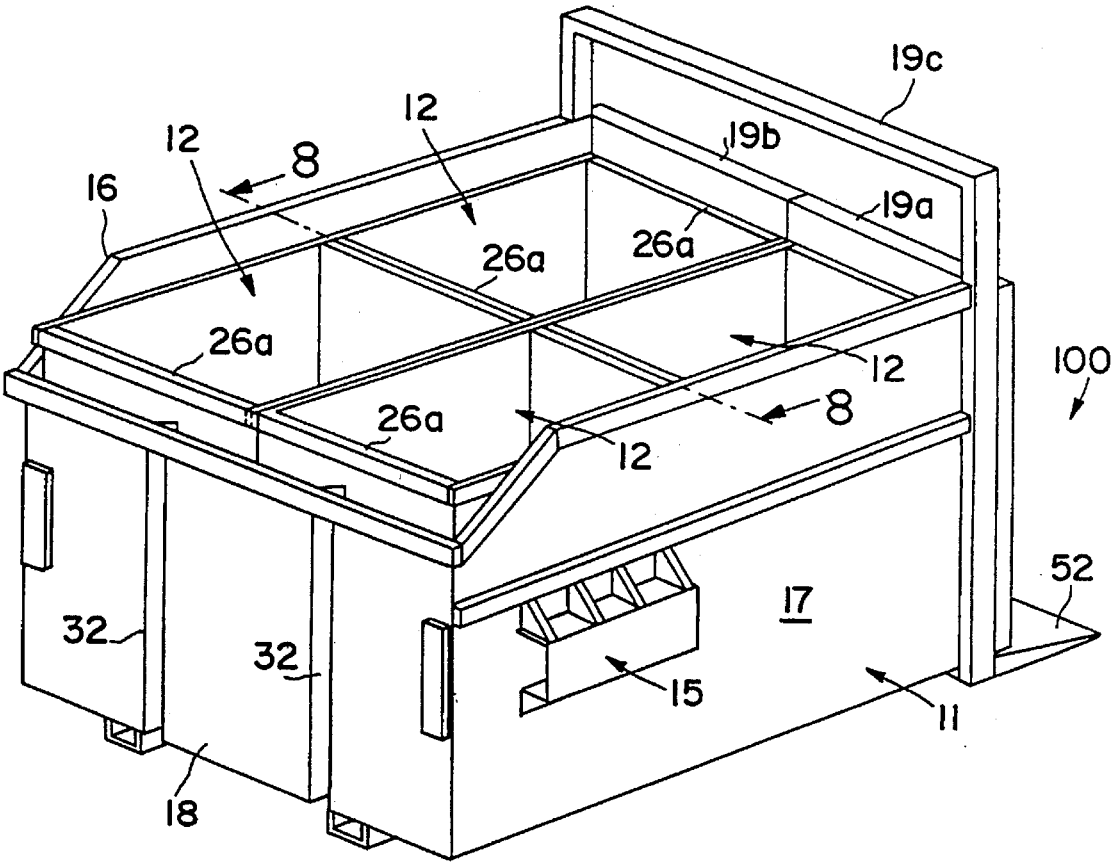
FIG. 7 is a perspective view of a container assembly according to a second embodiment of the present invention.
Figure 9:
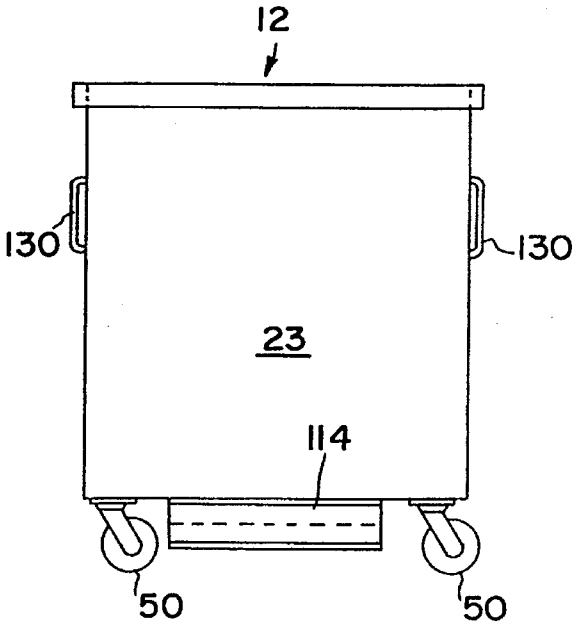
FIG. 9 is a side view of one of the mobile containers shown in FIG. 8.
Figure 8:
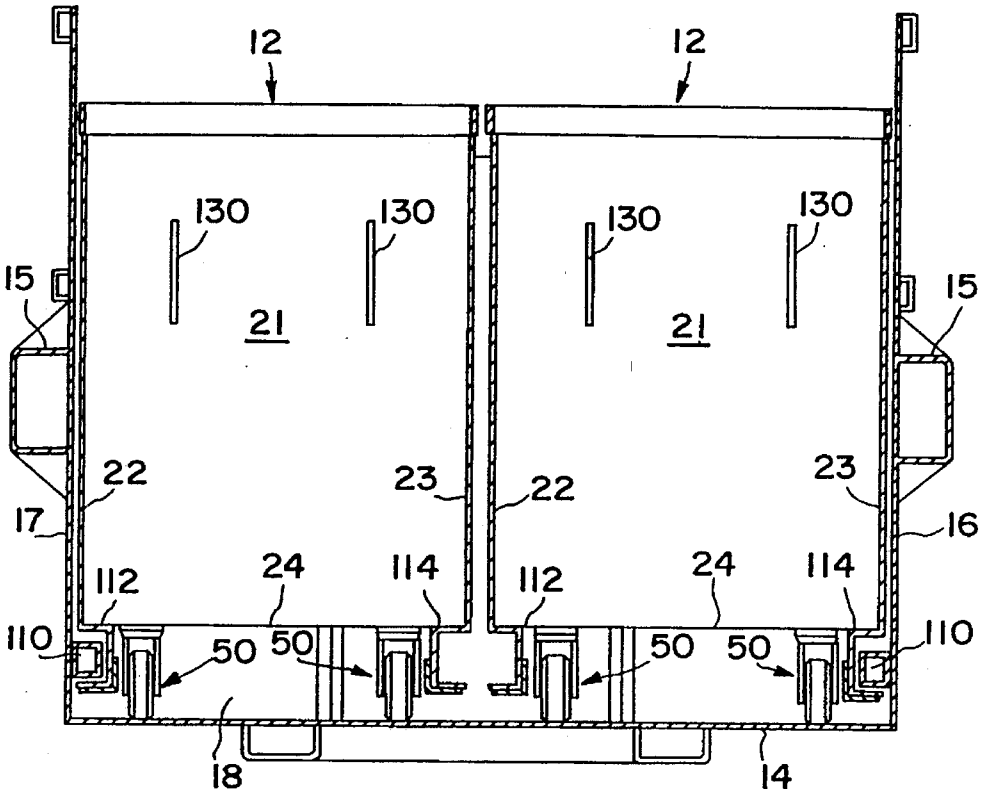
FIG. 8 is a sectional end view taken along line 8—8 in FIG. 7.

An alternative embodiment 100 is illustrated in FIGS. 7 to 9. Embodiment 100 includes an alternative form of container tipping support to that of the embodiment of FIGS. 1 to 6 and 10 similar parts have been designated by the same reference numerals.

In embodiment 100 each side wall 16,17 is provided with an elongate rail 110 which is located adjacent to the floor 14. Each rail 110 extends for the full length of the associated side wall and projects into the interior of the housing 11.

Each container 12 is provided with a pair of channel members 112,114. The channel members 112,114 are each secured to the bottom 24 of the container so as to extend along opposed side walls 22,23 respectively in a contiguous manner. The height of rails 110 above floor 14 is arranged such that when the containers 12 are wheeled into the housing 11, one of the rails 110 enters into a channel member 112 or 114. When all four containers 12 are in position, a channel member 112 or 114 of each container 12 is in engagement with a rail 110 such that on tipping of the housing the rails and channel members co-operate to retain the container within the housing. Accordingly with embodiment 100 the housing 11 may be fully open topped without tipping support 40.

As seen in FIG. 8, the buggy wheels 50 are located in-board of the channel members 112,114 so as not to interfere with co-operation between the rails 110 and channel members.

Preferably containers 12 are provided with handles 130 located on the opposed end walls 20,21 for facilitating wheeling of the containers 12. The handles 130 are arranged so as not to project beyond the boundary of the rim 26.

In the illustrated embodiments, each container 12 is described as having a generally square or rectangular cross-section which as shown is generally constant throughout the height of the container. This is preferred as it utilises the maximum of the available space within the housing 11. It will be appreciated however that the containers 12 may be differently shaped without departing from the scope of the invention.

The housing 11 of the illustrated embodiment is specifically adapted for co-operation with a front end loading vehicle. However it will be appreciated that the housing 11 may be adapted for co-operation with other types of tipping apparatus, such as for example a rear end loading vehicle.

What is claimed is:

1. A waste container assembly, comprising:

a housing including a plurality of mobile containers, wherein said housing is adapted for engagement with a tipping apparatus capable of raising the housing to an elevated tipped position where at said housing is positioned upside down to permit contents of said containers to be emptied therefrom, wherein said housing includes a tipping support for holding each of said mobile containers captive within said housing when said housing is in said elevated tipped position, said housing having opposed end walls and opposed sidewalls defining an internal space; and each of said mobile containers having a plurality of wheels and having a cross-section and size to nest together and substantially fill said internal space of said housing, wherein said tipping support of said housing abuts said containers for preventing said containers from falling out of said housing when said housing is positioned in said elevated tipped position.

2. The assembly according to claim 1, wherein said mobile containers abut each other and said walls of said housing when positioned in said housing in said nested condition so as to be restrained from lateral movement.

3. The assembly according to claim 1, wherein the housing has an open top and said tipping support comprises at least one elongated frame member extending across said open top of said housing, wherein said at least one elongated frame member is engageable with an upper edge of said mobile containers when said housing is in said tipped position for retaining said containers within said housing.

4. The assembly according to claim 1, wherein said mobile containers include means for engaging said tipping support and wherein said housing has an open top, and wherein said tipping support is located below said open top for engaging said means for engaging, said tipping support comprising a rail mounted on said housing and said means for engaging for engaging said rail, wherein said means for engaging is received on said rail and holds said mobile containers captive within said housing when in said elevated tipped position.

5. The assembly according to claim 4, wherein said rail is mounted on each of said opposed sidewalls and said rail extends between said opposed end walls and wherein said means for engaging comprises a channel member for engaging said rail.

6. The assembly according to claim 4, wherein said rail is mounted on each of said opposed sidewalls and extends between said opposed end walls, and wherein each of said movable containers includes a bottom wall, said plurality of wheels and said means for engaging, said means for engaging comprising a pair of channel members mounted on said bottom wall, and wherein at least one of said channel members is located so as to be contiguous with at least one of said opposed sidewalls of said housing, said plurality of wheels being located inward of said channel members.

7. The assembly according to claim 1, wherein said housing includes a floor having tracks along which said wheels of said containers run when said containers are wheeled into and out of said housing.

8. The assembly according to claim 1, wherein one of said end walls is operable to permit containers to be wheeled into and out of said housing.

9. The assembly according to claim 1, wherein said housing is adapted for connection to elevation means of a front or rear end loading container vehicle.

* * * * *